United States Patent [19]

Whitfield

[11] 3,957,106

[45] May 18, 1976

[54] SEAL FOR GAS TURBINE REGENERATOR

[75] Inventor: James Harold Whitfield, Royal Oak, Mich.

[73] Assignee: Chrysler Corporation, Highland Park, Mich.

[22] Filed: Oct. 15, 1974

[21] Appl. No.: 514,522

[52] U.S. Cl. ..... 165/9; 60/39.51 H

[51] Int. Cl.[2] ..... F23L 15/02; F02C 7/10

[58] Field of Search ..... 60/39.51 H; 277/27, 277/74, 84; 165/9

[56] References Cited

UNITED STATES PATENTS

| | | | |
|---|---|---|---|
| 3,234,999 | 2/1966 | Atwood | 165/9 |
| 3,351,127 | 11/1967 | Mendelsohn | 60/39.51 H |
| 3,401,740 | 9/1968 | Trudeau | 165/9 |
| 3,692,097 | 9/1972 | Penny | 165/9 |
| 3,719,226 | 3/1973 | Vallance | 165/9 |
| 3,780,791 | 12/1973 | Barnard | 165/9 |
| 3,856,077 | 12/1974 | Siegla | 165/9 |

*Primary Examiner*—Carlton R. Croyle
*Assistant Examiner*—L. J. Casaregola
*Attorney, Agent, or Firm*—Talburtt & Baldwin

[57] ABSTRACT

Fixed seal means partition a disc type rotary regenerator for an automotive gas turbine engine into an inlet air heating section for conducting cool high pressure inlet air therethrough in one axial direction and an exhaust cooling section for conducting hot low pressure exhaust gas therethrough in the opposite axial direction. The seal means comprises a non-rotatable rubbing seal having an inner surface in sliding sealing engagement with an axial end surface of the regenerator and also comprises a channel shaped non-rotatable static seal having one channel side in sliding sealing engagement with a movement limiting stop fixed with respect to an outer surface of the rubbing seal at the low pressure side thereof and having a second channel side in sliding sealing engagement with a fixed housing portion of the engine. The channel sides of the static seal are spaced by a channel mouth opening toward the high pressure side of the seal, whereby the pressure differential across the seal urges the rubbing seal and the channel sides of the static seal into their aforesaid sliding sealing engagements. The movement limiting stop limits the movement of the static seal in the direction toward the low pressure side of the seal and cooperates with conventional pressure balancing grooves in said inner surface of the rubbing seal to effect a predetermined accurately controlled light pressure induced clamping force urging the rubbing seal into its sliding sealing engagement with the aforesaid axial end surface of the regenerator.

18 Claims, 11 Drawing Figures

SEAL FOR GAS TURBINE REGENERATOR

BACKGROUND AND OBJECTS OF THE INVENTION

Rotating regenerators are employed also with automobile gas turbine engines to improve fuel economy. A typical regenerator comprises a cylindrical matrix rotatable about its major axis and having a multiple of axially extending gas flow passages which are alternately indexed with two separate gas streams comprising comparatively low pressure hot exhaust gas and comparatively high pressure cool inlet air. The matrix is thus alternately heated and cooled, thereby to cool the exhaust gas before it is discharged to the atmosphere and to preheat the inlet gas or air prior to its entry into the combustion chamber. Non-rotatable seals which may comprise (1) a rubbing seal in sliding sealing engagement with an axial end surface of the regenerator and (2) a static seal between the rubbing seal and a fixed portion of the regenerator housing, define a boundary between said gas streams to limit leakage from the cooler high pressure inlet air to the hot lower pressure exhaust gas. Without such seals, a large proportion of the inlet air will bypass the regenerator and escape with the exhaust, resulting in poor economy, inefficient operation of the turbine engine, and difficult engine starting.

The regenerator rotating relative to the fixed housing must necessarily have sufficient clearance to allow for thermally induced relative movement between the regenerator and housing. Accordingly the static seal must have some capability for movement without excessive stress, must have sufficient strength during high temperature operation to withstand the pressure loads across it, and must conform to both the rubbing seal and housing to limit air leakage as the parts warp thermally. In addition the static seal must be inexpensive and sufficiently compact to fit in the limited space available.

Some seals known to the art perform fairly well in accomplishing the above requirements, but such seals are expensive and sensitive to dimensional tolerance, such that localized stress is often objectionable. An important object of the present invention is accordingly to provide an improved and comparatively low cost static seal that achieves the above requirements and also improves the operation of the rubbing seal, although it is generally independent of the specific rubbing seal construction.

In order to minimize wear and especially localized wear between the rubbing seal and regenerator surface and to reduce friction force tending to oppose rotation of the regenerator, a reasonably low and uniform clamping force between the regenerator and rubbing seal is desired. In a typical construction, the pressure force across the seal amounts to fifty to seventy-five pounds per square inch. Various devices are employed to partially counter-balance the pressure force exerted against the axially outer area of the rubbing seal remote from the regenerator, including devices to apply a counter-balancing pressure force over preselected axially inner areas of the rubbing seal proximate the regenerator. However, the means for providing counter-balancing pressures at opposite sides of the rubbing seal must be relatively free from the effects of thermal distortion of dimensional tolerances in order to maintain the desired uniform low pressure induced clamping load on the rubbing seal during changing engine operating conditions. Such has not been the case heretofore in gas turbine engines of the type with which the present invention is concerned.

The present invention therefore provides as another object a static seal that enables the aforesaid desired clamping load or force and is less sensitive to dimensional variations resulting from thermal distortion and production tolerances.

Another and more specific object of this invention is to provide, in combustion with a rubbing seal having its inner surface in sliding sealing engagement with an axial end surface of the regenerator, a static seal having separate portions in sliding sealing engagement respectively with the outer surface of the rubbing seal and with a non-rotatable portion of the regenerator housing. One of the members comprising the rubbing seal and housing portion provides an integral movement limiting stop in said sliding sealing engagement with the static seal and arranged to limit pressure induced movement thereof toward the low pressure side of the seal, thereby to locate the static seal accurately when under operating pressure.

In a preferred construction the static seal is channel shaped with its channel mouth in communication with the high pressure side of the seal and with its opposite channel sides in the aforesaid sliding sealing engagements. The movement limiting stop comprises the sidewall of an axially outwardly opening seal retaining groove extending linearly of the seal and having one of the channel sides of the static seal confined therein. The retaining groove is sufficiently deep axially to accommodate operationally induced relative axial movement between said one channel side therein and the aforesaid sidewall of the retaining groove without allowing the channel side to bottom within the retaining groove or to move completely out of the latter. During operation, the sealing engagement between the various sliding parts is maintained by the pressure differential across the seal.

Another object is to provide such a seal having resilient means confined between the bottom of the seal retaining groove and the channel of the static seal. The resilient means is under compression urging the rubbing and static seals to their operating positions in said sliding sealing engagements even when the turbine engine is not operating. Thus the efficiency of the seal during engine starting condition is increased and engine starting is facilitated.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

The elements shown in FIGS. 1–11 are illustrative only and are not to scale.

Figure 1:
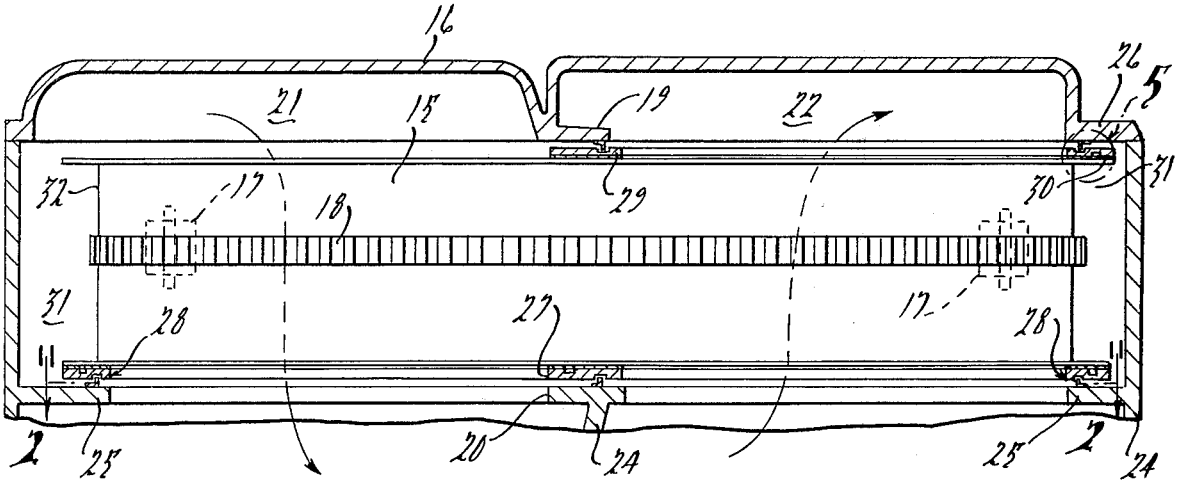
FIG. 1 is a fragmentary schematic sectional view taken substantially along the diameter of a regenerator for a gas turbine engine and transversely to the regenerator cross arm seal, showing portions of the regenerator housing and the scale embodying the present invention.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Referring to the drawings, a typical disc type regenerator 15 for an automobile gas turbine engine is supported rotatably within a housing 16, as for example by driving and idler gears 17 meshed with a ring gear 18 secured to the outer periphery of the regenerator 15. Upper and lower platforms 19 and 20 integral with the housing 16 partition the latter into a comparatively high pressure inlet chamber 21 and a low pressure exhaust chamber 22 in communication respectively with a comparatively cool source of high pressure inlet air and with an exhaust conduit to the atmosphere.

Figure 2:
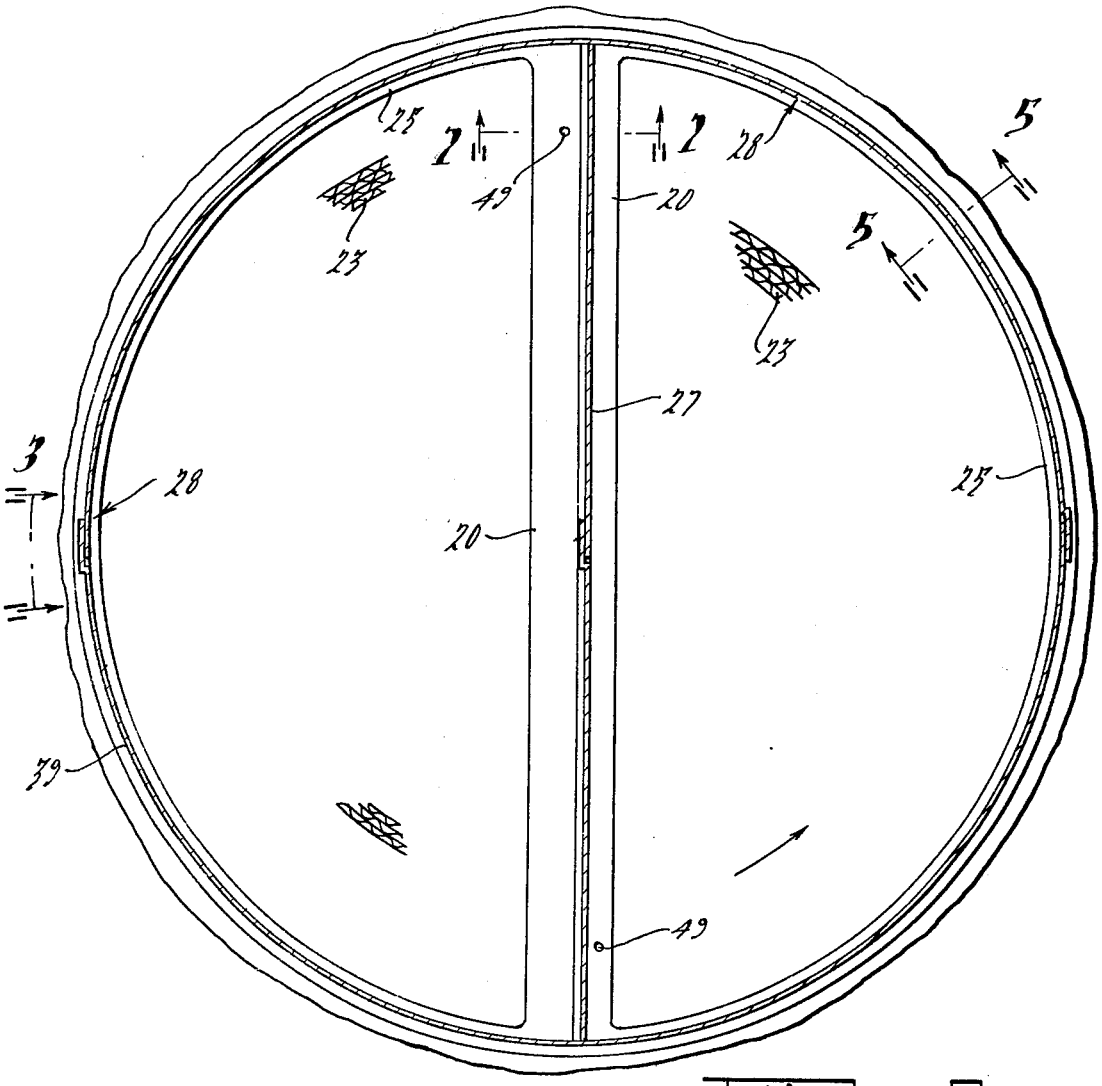
FIG. 2 is a sectional view taken in the direction of the arrows substantially along the line 2—2 of FIG. 1, showing the static seal.

Fresh combustion supporting air at a pressure of approximately three to four atmospheres and 350°F enters chamber 21 from an engine driven air compressor, not shown, flows downwardly through the approximate left inlet half of the regenerator matrix 23, which comprises a multitude of generally parallel axially extending gas passages, and is then conducted by suitable conduit means (indicated generally at 24) of the housing 16 to a combustion chamber and thence to the rotor stages of the gas turbine engine, not shown, as indicated by the arrows in FIG. 1. From the rotor stages, the hot exhaust gas is conducted via the aforesaid conduit means 24 to the underside of the approximate right exhaust half of the regenerator matrix 23. The hot exhaust gas flows upwardly through the right half of the regenerator matrix 23 to heat the latter and is thereby cooled by the time it enters chamber 22. As the regenerator 15 rotates in the direction of the arrow, FIG. 2, the portions thereof that were heated by the exhaust gas are continuously rotated into the flow path of the cool inlet air at 21, which air is then preheated by passing through the hot matrix at the left half of the regenerator 15.

In consequence, the axial temperature gradient will exist across the regenerator from its coller upper surface to its hotter lower surface. Also by reason of the continuously changing temperature and pressure conditions to which the separate portions of the regenerator matrix 23 are subject, the latter will be continuously distorted. Difficulty has accordingly been experienced in the provision of an effective seal to prevent the cool high pressure inlet air from leaking into the low pressure exhaust gases and bypassing the regenerator or rotor stages.

In the present instances an annular lower platform 25 of the housing 16 is provided under the periphery of the regenerator 15 in the plane of the platform 29. Similarly to the annular platform 25, a semi-annular upper platform 26 extends in the plane of the platform 19 around the upper periphery of the right exhaust half of the regenerator 15. Disposed generally diametrically completly across the undersurface of the regenerator 15, between the latter and the platform 20, is a lower cross arm or sector seal 27 which cooperates with an annular peripheral seal 28 disposed between the underside of the periphery of the regenerator 15 and the platform 25 to partition the underside of the regenerator 15 into the right and left substantially semi-circular sectors, FIG. 2.

Overlying the lower sector seal 27 and disposed between the upper surface of the regenerator 15 and platform 29 is an upper sector seal 29 similar to the seal 27. Extending around the right peripheral portion of the regenerator 15 from the opposite ends of seal 29 is a substantially semi-circular seal 30 disposed between the upper periphery of the regenerator 15 and platform 26. The seals 29 and 30 cooperate to provide a D-shaped seal overlying the corresponding portions of the seals 27 and 28 and partitioning the upper surface of the regenerator 15 and the inlet air within chambers 21 and 31.

Figure 5:
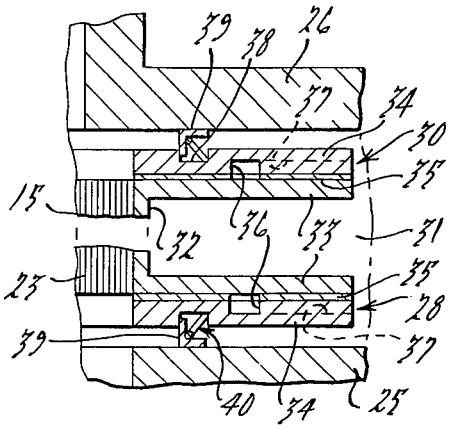
FIG. 5 is a fragmentary enlarged sectional view taken in the direction of the arrows substantially along the line 5—5 of FIG. 2, showing the static seal in the operative condition.

In FIGS. 1 and 5, the periphery of the regenerator 15 comprises a rim 32 considerably thicker than the sidewalls of the individual gas passages of the matrix 23 and providing upper and lower integral rim flanges 33, FIG. 5, in sealing contact with the seals 28 and 30 as described below. The material of the regenerator 15, including the rims 32, 33 may comprise a metal, such as stainless steel, or a suitable plastic capable of withstanding the pressure and temperatures involved.

In the present instance, the comparatively cool high pressure inlet air entering at 21 from the compressor is also in communication with an annular chamber 31 that extends completely around the regenerator rim 32, thereby to bathe the latter in cool air which balances the external pressures on the regenerator core and insulates the matrix 23 from the vehicle engine compartment. As illustrated in FIGS. 1 and 5 by way of example, the rim flanges 33 are flush with the axial end surfaces of the regenerator matrix 23. The rim 32 is welded or otherwise suitably secured to the periphery of the regenerator matrix 23. With such a construction, the seals 28 and 30 are in sliding, sealing engagement with the flanges 33. However, as illustrated in FIGS. 8 through 11 for example, the rim flange 33 may be eliminated. The seals 28 and 30 are then provided in sliding and sealing engagement with the outer peripheral portion of the regenerator matrix 23.

Details of the seals 28 and 30 are illustrated in FIG. 5. Except for the fact that the seal 28 extends annularly completely around the lower periphery of the regenerator 15 to prevent radial inward flow of high pressure air from chamber 31 between the lower flange 33 and the underlying platform 25, and the seal 30 extends only semi-circularly around the upper right half or low pressure exhaust region of the matrix 23 to seal chamber 22 from the higher pressure gases in chambers 21 and 31, the seals 28 and 30 are substantially alike and may in fact be mirror images of each other. Accordingly corresponding parts of both seals are numbered the same, although it will be realized that because of the different pressure and temperature operating conditions that prevail at the seals 28 and 30, the dimensions of the parts in seals 28 and 30 may not be identical.

Each of the seals 28 and 30 comprises a flat annular rubbing seal 34. The latter comprises a thin annular plate of material such as stainless steel approximately an eight of an inch thick, or in some instances a thicker plate of compacted graphite adapted to withstand the operating temperature condition and to flex axially to conform closely to the continuously warping confronting axial end surfaces of the regenerator 15 which in the instance of FIG. 5 are the rim flanges 33. In other respects, each rubbing seal 34 is comparatively rigid. The surface of the rubbing seal 34 confronting the regenerator 15 may be coated with a thin layer of a sealing material 35, in which case the plate 34 primarily serves as a back-up reinforcing support for the sealing material 35.

In order to provide a desirable distribution of pressure over the surface of each rubbing seal 34 and to reduce the force of the operating pressure thereon tending to urge it against the confronting surface of the regenerator 15, an annular pressure balancing groove 36 is provided in the axially inner surface of each seal 34 confronting the regenerator 15 and is connected by one or more radial grooves 37 to the high pressure that exists during operation at the periphery of the regenerator 15. It is thus apparent that the high pressure existing in the annular chamber 31 will be conducted via grooves 37 to the circumferentially extending pressure balancing groove 36 and no pressure gradient will exist between the latter groove and the outer periphery of the seal.

Cooperable with the groove 36 in a manner that will be explained below in a circumferentially extending retaining groove 38 in the axially outer surfaces of the seals 34 confronting housing platforms 25 and 26. A circumferentially extending static seal 39 of channel or L-shaped section has one channel side flush with the confronting surface of the platforms 25 or 26 and its other channel side extending into the associated groove 38 for confinement therein. Each seal 39 is freely floating with respect to the platform 25 and 26 and groove 38 and unless suitably supported will drop downwardly from the positions illustrated in the FIG. 5 when the engine is not operating. The channel of the seal 39 opens toward the radially outer high pressure side of the seal so that as soon as the regenerator 15 is subject to operating pressures, the high pressure of the right of the seals 39 will immediately force the latter leftward and axially outward until the axially extending channel side of each seal 39 seats against the radially inner left wall of its groove 38, FIG. 5, and the other channel side of each seal 39 seats against the adjacent platform 26 or 25 as the case might be.

Figure 6:
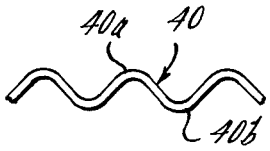
FIG. 6 is a fragmentary enlarged view elevational view of the spring employed in FIG. 5 to maintain the rubbing and static seals in their respective positions of sealing engagement.

The depth of each groove 38 is adequate to enable flexing and distortion of the associated seal 34 in conformity with thermal distortion of the regenerator 15, without enabling the axially extending channel side of the static seal 39 to bottom within its groove 38. Such deformity might result in 0.05 to 0.06 inch of axial movement of the seal 34 from its undeformed condition, but seldom if ever as much as 0.1 inch in a typical construction. The seal 39 is of material such as thin stainless steel capable of withstanding the operating temperatures and pressures, yet adapted to flex to a limited extent so as to conform closely to the aforesaid movement limiting channel wall of groove 38 and the confronting surface of the platform 25 or 26 in sliding sealing engagement therewith. On the other hand the seal 39 is of sufficiently rigid material that the angle of the L-section does not deform appreciably during operation. In a typical construction the legs of the L-section may be on the order of approximately 0.1 to 0.2 inch long and 0.01 inch thick.

Where conditions require, as for example when the inlet air pressure at 21 is comparatively small during engine starting, as compared to the normal operating pressure, a light spring 40 may be employed between the base of the retaining groove 38 (adjacent the latter's radially outer wall) and the bottom of the channel of the seal 39 to hold the latter at all times in the sealing position shown regardless of engine operation. Thus during engine starting, leakage across the static seal 39 will be minimized and engine starting will be facilitated. As soon as engine operating pressures are attained, the pressure differential across the seal 39 will maintain the latter firmly and positively in the sealing condition shown, FIG. 5. An example of a spring 40 illustrated more clearly in FIG. 6 comprises a convoluted resilient wire adapted to extend circumferentially along the seal 39 and resiliently engage the latter and the bottom of the groove 38 as described above at a number of closely spaced points 40a and 40b respectively, which comprise the alternate crests of the convoluted spring 40.

Figure 7:
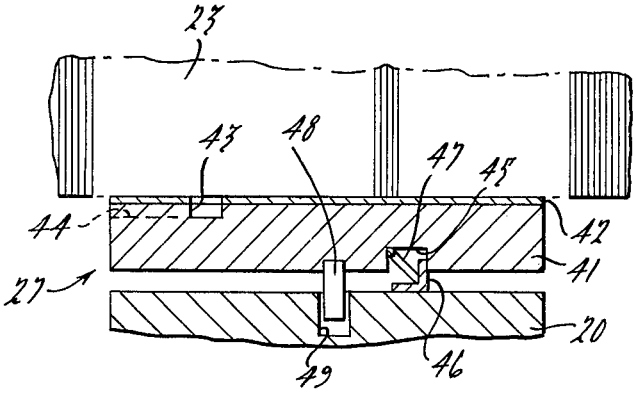
FIG. 7 is a fragmentary enlarged sectional view through the cross arm seal taken in the direction of the arrows substantially along the line 7—7 of FIG. 2. Only the lower seal at the hot surface of the regenerator is shown.

The peripheral seals 28 and 30 extend to the diametrically opposite ends of the sector or cross arm seals 27 and 29 respectively, which latter seals may also be substantially mirror images of each other except for possible small dimensional differences to accommodate different temperature and pressure conditions that exist axially across the regenerator 15. Accordingly only the lower sector seal 27 is illustrated in FIG. 7. The sector or cross arm seal 27 includes a cross arm rubbing seal 41 which comprises a back-up plate or support for a comparatively thin sealing coating 42 similar in structure and operation to the members 34 and 35 respectively. Each seal 41 extends diametrically to the corresponding seal 34 and may be integral therewith. Also a pressure balancing groove 43 is connected with the high pressure at the left edge of the seal 27 in FIG. 7 by one or more grooves 44. The grooves 43 and 44 are provided in the axially inner surface of the cross arm seal 41 confronting the regenerator 15, thereby to eliminate any pressure gradient between the high pressure edge of the seal 27 (left side in FIGS. 2 and 7) and the groove 43. Although the pressure balancing grooves 36, 43 are connected to the high pressure in the present instance, similar pressure balancing grooves connected to the pressure at the low pressure side of the seal may also be employed.

A retaining groove 45 in the axially outer side of the seal 41 is provided to predetermine the location of a channel shaped or L-section static seal 46. The latter has an axially extending channel side confined within the groove 45 and a transverse channel side adapted to seat on a surface portion of the support 20. The groove 45 and static seal 46 extend the length of the seal 41 and merge respectively with the circumferential retaining groove 38 and the static seal 39. In other respects the seal 46 and retaining groove 45 are similar in structure and function to the seal 39 and retaining groove 35, except for dimensions. The axial side of the seal 46 may be longer than the corresponding side of the seal 39 because the maximum thermal distortion will usually be at the region of the diametrical seal 27. Similarly to spring 40, a convoluted spring 47 may be employed between the channel of the static seal 46 and base of the retaining groove 45, as illustrated in FIG. 7. Rotation of the integral seals 34 and 41 upon rotation of the regenerator 15 is prevented by suitable means such as two or more pins 48 which may be secured in the axially outer surfaces of the seals 41 and which extend freely slidably into openings 49 provided in the confronting surfaces of the platforms 19 and 20.

By the structure described, at the underside or hot surface of the regenerator 15, FIG. 1, an annular lower static seal 39 extends circularly within groove 38 entirely around the axis of regenerator rotation in the underside of the lower rubbing seal 34 for the peripheral seal 28 and is approximately bisected by the lower diametrical static seal 46. The opposite ends of the diametrical seal 46 may be in sliding engagement with the adjacent portions of the peripheral seal 39, or may be joined thereto, as for example by welding. Similarly to the channel of the seal 39, the channel of seal 46 opens in the direction towards the high pressure. Thus during operation of the regenerator, the pressure differential across the seals maintain the channel sides of the seals 39 and 46 in sliding sealing contact with the corresponding wall of the groove 38 or 45 at the low pressure side of the seal and with the corresponding flush surface of the annular support 25 or diametrical support 20 of the housing 16.

It is to be noted that the arrangement of the static seals 39 and 46 in their respective retaining grooves 38 and 45 cooperate with the pressure balancing grooves 36 and 43 respectively to achieve the desired pressure loading of the rubbing seals 34 and 41 against the regenerator 15. In the latter regard, the high pressure at the right of the seal 39 in FIG. 5 for example will extend between the rubbing seal 34 and the corresponding platform 25 or 26 radially inwardly from the outer periphery of the regenerator to the location of the seal 39. The portion of the rubbing seal 34 leftward of the axially extending channel side of the seal 39 will be in the low pressure region of the regenerator 15. By suitably locating the groove 38 with respect to the pressure balancing groove 36, the optimum light pressure force urging the rubbing seal 34 into its sliding sealing contact with the regenerator 15 (i.e. the rim flange 33 in FIG. 5) is obtained. The only unopposed high pressure acting with the rubbing seal 34 will be at the region of the latter readily inward or leftward of the pressure balancing groove 36 and radially outward or rightward of the axially extending channel side of the static seal 39 in FIG. 5. This area exposed to the unopposed high pressure may be increased or decreased or shifted radially inwardly or outwardly by suitably adjusting the positions of the grooves 38 and 36. Similarly the unopposed high pressure will be exerted against the rubbing seal 41 only between the axially extending channel side of the seal 46 and the adjacent wall of the groove 43.

The retaining grooves 38 and 45 may be formed in the seals 34 and 41 simultaneously with formation of the pressure balancing grooves 36, 37 and 43, 44 respectively with a minimum of additional expense. The cooperating grooves 36, 38 and 43, 45 enable the use of comparatively large sealing surface areas for the rubbing seals 34 and 41 and at the same time enable a pressure induced uniform low clamping force holding the seals 34 and 41 in sliding sealing engagement with the regenerator 15, thereby minimizing frictional wear and power loss. The locations of the grooves 36, 38 and 43, 45 are also relatively stable during operation, so that localized excessive pressure loading and uneven wearing of the seals and matrix are minimized.

In accordance with the structure shown in FIGS. 5 and 7, operational distortion of the regenerator 15 is not imparted to the static seals 39 and 46 by virtue of their axially extending channel sides in sliding and sealing engagement with the walls of the corresponding grooves 38 and 45. The latter channel sides extend axially sufficiently so that they will not move out of the corresponding groove 38 or 45 and loose sealing contact. Also the retaining grooves 38 and 45 are sufficiently deep so that the axially extending channel sides of the static seals 39 and 46 will not bottom within the retaining groove during periods of maximum distortion of the rubbing seal.

The rubbing seals 34 and 41 are sufficiently flexible out of the plane normal to the axis of rotation so as to conform closely to the confronting surface of the regenerator 15 and maintain the sliding sealing contact therewith. Less corresponding flexibility for the static seals 39 and 46 is required because less distortion is experienced by the housing supports 19, 20, 25 and 26. However, the static seals 39 must freely expand circumferentially and the seals 36 must expand diametrically to accommodate thermally induced dimensional changes during operation.

Figure 3:
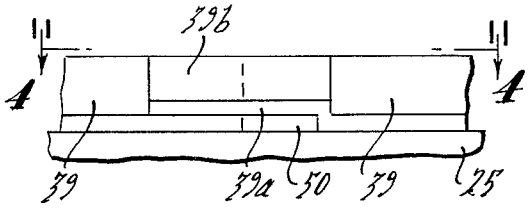
FIG. 3 is a fragmentary enlarged sectional view of the static seal, taken in the direction of the arrows substantially along the line 3—3 of FIG. 2, radially outer portions of the rubbing seal being removed to show details of structure.
Figure 4:
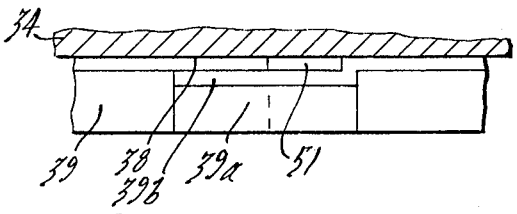
FIG. 4 is a fragmentary sectional view of the structure shown in FIG. 3, taken in the direction of arrows substantially along line 4—4 of FIG. 3.

In order to facilitate such dimensional changes and to enable the static seals 39 to seat in sliding sealing engagement against the platforms 25 and 26 and the movement limiting stop carried by seal 34, e.g. the left wall of groove 38 in FIG. 5, regardless of relative dimensional changes or movement between the parts during operation, each static seal 39 is discontinuous at locations midway between the opposite ends of the corresponding cross seals 27 and 29, but the discontinuous static seal portions 39 overlap in sliding sealing engagement with each other as illustrated in FIGS. 3 and 4. The radially and axially extending channel sides of the static seal portions 39 at the location illustrated in FIGS. 3 and 4 are offset at **39*a* and 39*b* respectively in an amount equal to the thickness of the channel walls so as to overlap and lie flush in sliding sealing engagement with the corresponding channel sides of the circumferentially adjacent seal portion 39. Slight gaps in the seals at 50 and 51 occasioned by the offsets 39*a* and 39*b* will result, but the circumferential extend of these gaps is held to the minimum required for the thermal expansion and contraction and the thickness of the gaps 50 and 51 is very small because the channel sides of the static seal 39** are comparatively thin.

Similar sliding sealing junctures are provided for the static seals 39 diametrically opposite the location illustrated in FIGS. 3 and 4 at both axial ends of the regenerator 15, i.e. above and below the latter in FIG. 1. Likewise a similar sliding sealing juncture is provided for the static seal 46 midway between the ends of each cross seal 27 and 29. By virtue of the discontinuities in the static seals 39 and 46 adjacent the axial mid-plane of the regenerator 15 transverse to the sector seals 27 and 29, simplification in the seal structure and its handling are achieved. Also joining of the ends of the sector static seals 46 with the associated peripheral static seals 39 by butt welding or other means is rendered feasible and leakage at the juncture between these seals is minimized. The circumferential temperature gradient in the seals is a minimum at the regions of the discontinuities, so that the offset portions 39*a* and 39*b* will conform more closely to the static seal portions they overlap, minimizing leakage. Also the overlapping junctures shown will accommodate a large amount of relative diametrical and circumferential expansion and contraction, which may not be uniform along the arc or diametrical extent of the seals.

Figure 8:
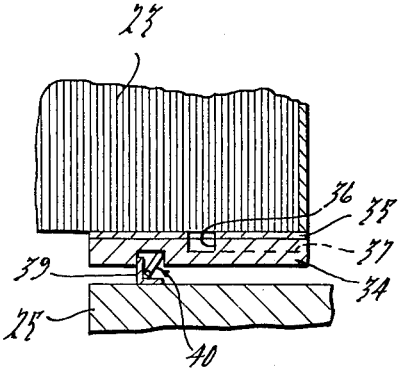
FIG. 8 is a view similar to the FIG. 5, but showing a modification of the invention wherein the rubbing seal slides directly on the regenerator matrix, rather than a radial flange of the latter. Only the lower seal at the hot surface of the regenerator is shown.

FIG. 8 illustrates a seal similar to that illustrated in FIG. 5, except the regenerator rim flange 33 is eliminated and the rubbing seal 34 is in sealing sliding engagement with the peripheral surface of the matrix 23, rather than with a rim flange 33.

Figure 9:
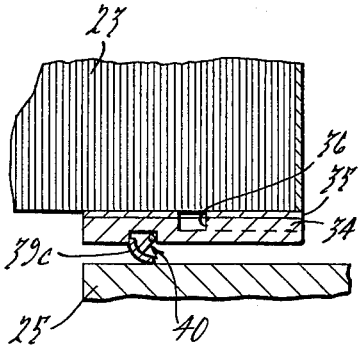
FIG. 9 is a view similar to FIG. 8, showing a modified form of the static seal.

FIG. 9 illustrates a similar seal except that the static seal 39c, instead of being L-shaped, is crescent in cross section. It is apparent that the cross section of the static seal may be variously shaped as long as one portion is provided for sliding and sealing engagement with a stop or projection on the rubbing seal and another portion of the static seal is provided for sliding and sealing engagement with the adjacent housing support, such as the supports 19, 20, 25 and 26.

Figure 10:
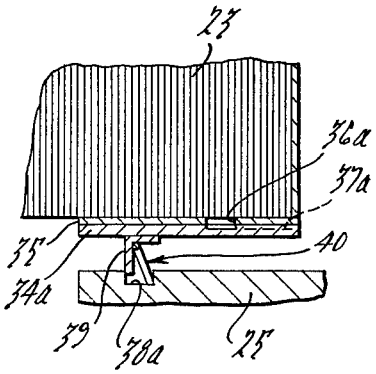
FIGS. 10 and 11 are views similar to FIG. 8, but showing modifications involving a comparatively thin flexible rubbing seal.
Figure 11:
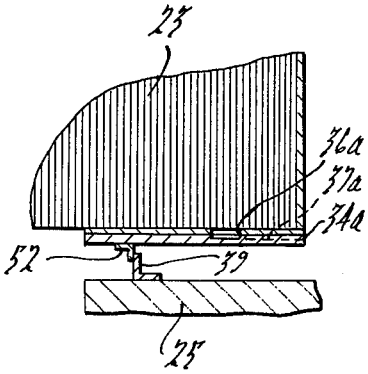

FIGS. 10 and 11 illustrate modifications wherein a rubbing seal 34a is required that is too thin to accommodate the retaining groove 38 or wherein the material of the seal 34*a* does not permit the welding or brazing of a stop (such as the stop 52) to the seal 34a. In fIG. 10 a groove 38a corresponding to the retaining groove 38 is provided in the support 25. In consequence, the axially extending channel wall of the static seal 39 is supported in sliding sealing engagement with a wall of the groove 38*a* and the radially extending channel side wall of the seal 39 is flush with the underside of the adjacent surface of the thin rubbing seal 34*a*. The static seal 39 in FIG. 10 may move relative to the pressure balancing groove 36*a* which is connected to the high pressure by radial grooves 37*a* as described above in regard to grooves 36 and 37. In consequence accurate control over the pressure force urging the rubbing seal 34a against the regenerator matrix 23 is more difficult than in the structure of FIGS. 5–9. In other respects the function and operation of the parts are similar to those described above.

FIG. 11 shows a retainer or stop 52 extending linearly of the seal and suitably secured to the thin rubbing seal 39*a*, as for example by being brazed or welded thereto, so as to enable the same control over the pressure balancing force as in FIGS. 5–9. The stop 52 extends axially from the seal 34a toward the support 25 to effect a sliding sealing engagement with the axially extending channel wall of the static seal 39 as illustrated. Another advantage of such a structure over that shown in FIG. 10 is that the static seal 39 in FIG. 11 is isolated after the dimensional distortions of the rubbing seal 34a which latter seal must conform to the confronting surface of the regenerator matrix 23 as the latter is distorted during operation. In FIG. 10, the static seal 39 must conform to distortions of rubbing seal 34*a* in order to maintain the sliding and sealing engagement therewith.

Having thus described my invention I claim:

1. In a gas turbine engine having a rotatable regenerator and conduit means for conducting separate gas streams to and from said regenerator at separate locations to transfer heat from the hotter to the cooler gas streams upon rotation of said regenerator, the combustion of sealing means for accommodating relative distortion of said regenerator and conduit means resulting from different and changing physical conditions of said gas streams and defining a boundary for at least one of said streams, said sealing means comprising a rubbing seal and a static seal, said rubbing seal having a portion in sliding fluid sealing engagement with said regenerator at said boundary, said static seal comprising a channel of substantially L-shaped cross section opening toward the high pressure side of said boundary and defined by a pair of channel sides maintained by the fluid pressure differential across said boundary in sliding fluid sealing engagement respectively with portions of said rubbing seal and conduit means at said boundary, said channel sides being dimensioned and arranged between the two members comprising said rubbing seal and conduit means to provide sufficient axial and radial lost motion freely with respect thereto to avoid compression therebetween in consequence of said relative distortion, said portions of said members in said sliding engagement with said channel sides comprising a) an axially extending portion of one of said members in sliding fluid sealing engagement with one of said channel sides at the low pressure side of said boundary and b) a radially extending portion of the other of said members in sliding fluid sealing engagement with the other of said channel sides at the low pressure side of said boundary, the terms axial and radial being with reference to the axis of rotation of said regenerator.

2. In the combination according to claim 1, said rubbing seal having a pair of edges generally parallel to said boundary, and said axially extending portion extending along said boundary at locations between said edges.

3. In the combination according to claim 1, said seals comprising comparatively rigid materials, said rubbing seal having an inner side confronting the surface of said regenerator in said sliding sealing engagement and having an outer side, one of the channel sides of said static seal being in said sliding sealing engagement with said rubbing seal at said outer side thereof, said rubbing seal being resiliently yieldable to flex toward and from said regenerator surface to conform thereto in said sliding sealing engagement during operational distortions of the latter, said static seal extending along said boundary and being resiliently yieldable to flex transversely of said boundary to conform to said rubbing seal and conduit means in said sealing engagement therewith during their operational distortions.

4. In the combination according to claim 1, said regenerator comprising a multitude of small gas passages for passage of said gas streams axially therethrough and having axially opposite and surfaces transverse to its axis of rotation and confronting said conduit means at said locations, said rubbing seal having an inner side in said sliding sealing engagement with one of said axial end surfaces at said boundary and having an outer side confronting said conduit means, said static seal having its channel sides in said sliding sealing engagement with confronting portions of the members, comprising said rubbing seal and conduit means.

5. In the combination according to claim 4, said axially extending portion being integral with the outer side of said rubbing seal.

6. In the combination according to claim 4, said axially extending portions being integral with said conduit means.

7. In the combination according to claim 1, means supplemental to the pressure differential across said boundary for yieldingly urging said rubbing and static seals into their respective sliding sealing engagement with said regenerator and conduit means.

8. In the combination according to claim 1, means for yieldingly urging said rubbing seal and static seal into their respective sliding sealing engagements with said regenerator and conduit means including resilient means interposed between said static seal and at least one of said members comprising said rubbing seal and conduit means.

9. In the combination according to claim 8, said resilient means having a portion engaging said static seal within the channel thereof and said one member under compression yieldingly urging said static seal in the direction from the high pressure toward the low pressure side of said boundary.

10. In the combination according to claim 1, one of the members comprising said rubbing seal and conduit means having a retaining groove therein extending along said boundary, said axially extending portion including a wall of said groove in sliding sealing engagement with one channel side of said static seal.

11. In the combination according to claim 10, means for yieldingly urging said rubbing seal and static seal into their respective sliding sealing engagements with said regenerator and conduit means including resilient means interposed between said static seal within the channel thereof and said one member within said retaining groove thereof.

12. In the combination according to claim 11, said one member comprising said rubbing seal, the latter having an inner side in said sliding sealing engagement with said regenerator and having an outer side, said outer side having said retaining groove therein.

13. In the combination according to claim 11, said one member comprising said conduit means.

14. In the combination according to claim 11, said rubbing seal having an inner surface in said fluid sealing engagement with said regenerator, a pressure balancing groove in said inner surface extending generally parallel to said retaining groove at a location spaced therefrom in the direction from the low pressure to the high pressure side of said boundary, and means for connecting said pressure balancing groove with the pressure at the high pressure side of said boundary.

15. In the combination according to claim 1, said axially extending portion also extending along said boundary at the low pressure side of one channel side of said static seal in sliding sealing engagement therewith, said rubbing seal having an inner surface in said fluid sealing engagement with said regenerator, a pressure balancing groove in said inner surface extending generally parallel to said boundary at a location spaced from said axially extending portion in the direction from the low pressure to the high pressure side of said boundary, and means for connecting said pressure balancing groove with the pressure at the high pressure side of said boundary.

16. In the combination according to claim 1, said regenerator comprising a multitude of small gas passages for passage of said gas streams axially therethrough and having an axial end surface transverse to the axis of rotation and confronting said conduit means, said rubbing seal comprising a sector rubbing seal extending across said axial end surface to partition the same into two sectors and also comprising an arcuate rubbing seal extending along the periphery of one of said sectors, said sector and peripheral rubbing seals having inner sides in sliding sealing engagement with said axial end surface along said boundary and having outer sides confronting said conduit means, said static seal comprising a static sector seal and a static arcuate seal having one channel side of each in sliding sealing engagement with said sector rubbing seal and arcuate rubbing seal respectively at their said outer sides and having the other channel side of each in sliding sealing engagement with portions of said conduit means.

17. In the combination according to claim 16, said axially extending portion including a stop integral with one of the members comprising said rubbing seal and conduit means, said stop extending along said boundary at the low pressure side of one of the channel sides of said sector and arcuate static seals in said sliding sealing engagement therewith.

18. In the combination according to claim 17, said static sector seal being joined at its opposite ends to said static arcuate seal, and means for accommodating linear expansion and contraction of the latter seals while maintaining said sliding sealing engagements comprising discontinuities therein between their ends.

* * * * *